US005949464A

United States Patent [19]

Hirata et al.

[11] Patent Number: 5,949,464

[45] Date of Patent: Sep. 7, 1999

[54] RECORDING DEVICE

[75] Inventors: Susumu Hirata, Ikoma-gun; Hirotsugu Matoba, Sakurai; Yorishige Ishii, Yamatotakada; Shingo Abe, Tenri; Tetsuya Inui, Nara, all of Japan

[73] Assignee: Sharp Kabushiki Kaisha, Osaka, Japan

[21] Appl. No.: 08/895,912

[22] Filed: Jul. 17, 1997

[30] Foreign Application Priority Data

Sep. 26, 1996 [JP] Japan ..... 8-254204

[51] Int. Cl.[6] ..... B41J 2/445; B41J 2/475

[52] U.S. Cl. ..... 347/171; 347/213; 347/224

[58] Field of Search ..... 347/171, 213, 347/224

[56] References Cited

U.S. PATENT DOCUMENTS 4,580,142 4/1986 Matsushita ..... 347/213

FOREIGN PATENT DOCUMENTS 5-147209 6/1993 Japan .

*Primary Examiner*—Huan Tran

*Attorney, Agent, or Firm*—Nixon & Vanderhye, P.C.

[57] ABSTRACT

A recording device having a highly integrated recording head, which can perform high-quality high-speed printing of halftone image and which is compact and inexpensive to manufacture and can work at reduced running cost (with no need of replacing its recording head due to contamination with ink) and at saved power consumption. The recording device comprises an ink feeding unit for applying ultraviolet curing ink to an image transfer intermediate, an ultraviolet ink-curing head for selectively ultraviolet curing ink applied to the image transfer intermediate according to an image pattern, a platen for pressing a recording medium against the image transfer intermediate to transfer not-cured ink from the image transfer intermediate onto the recording medium, ultraviolet thermal ink-curing unit for fixing the ink on the recording medium and an ink removing unit for removing residual ink from the image transfer intermediate.

7 Claims, 8 Drawing Sheets

RECORDING DEVICE

BACKGROUND OF THE INVENTION

Japanese Laid-open Patent Publication (TOKKAI HEI) No. 5-147209 discloses a recording device of the type that records an image by transferring ink onto an image transfer intermediate and then transferring ink therefrom onto a recording medium. This recording device has an ink jet head comprising a heating device and a piezoelectric ceramics, which ejects melt ink drops of hot-melt ink through its nozzles onto an image transfer intermediate, cools down the ink drops adhering to the surface of the image transfer intermediate and then heats again the ink to be melt and transferred onto a recording medium moving round the image transfer intermediate to form thereon an image.

However, the prior art recording method using a conventional art transferring drum involves the following problems:

(I) An ink-jet head made of piezoelectric ceramics is featured by poor integration not to be adaptable to high-speed printing.

(II) The ink-jet head for recording an image may be clogged with ink, requiring replacement by a spare head. This increases the running cost.

(III) The use of hot-melt ink requires a relatively large consumption of electric power for melting it and requires considerable time for preparation for printing.

SUMMARY OF THE INVENTION

The present invention relates to a recording device for transferring ink onto a recording medium and more particularly to a recording device for selectively curing ink on an image transfer intermediate, transferring not-cured ink therefrom onto a recording medium and fixing the ink by curing thereon.

The present invention was made to solve the above-mentioned problems and, therefore, has as its object the provision of a recording device of high integration, which is free from being clogged with ink and requires further reduced power consumption.

The present invention was made to provide the following recording devices:

(1) The first object of the present invention is to provide a recording device for recording an image pattern on a recording medium by ink onto an image transfer intermediate and further transferring the ink onto the recording medium, which is provided with ink applying means for applying a coat of liquid ink over the image transfer intermediate, ink curing means for selectively curing the liquid ink coat on the image transfer intermediate and transferring means for bringing still not-cured ink onto the recording medium by feeding the latter in contact with the image transfer intermediate.

(2) The second object of the present invention is to provide a recording device as mentioned in the first object, which is characterized in that the ink is ultraviolet curing ink and the ink curing means is provided with ultraviolet irradiation unit.

(3) The third object of the present invention is to provide a recording device as mentioned in the second object, which is characterized in that the ink curing means is provided with a deformable mirror deformably formed for reflecting ultraviolet radiation from the ultraviolet irradiation unit at an angle suited for the image pattern to be recorded and a slit for passing reflected light from the deformable mirror.

(4) The fourth object of the present invention is to provide a recording device as mentioned in the third object, which is characterized in that the deformable mirror comprises a cantilever having a mirror surface and driving portion for driving the cantilever with any one of heat, electric field and electrostatic field to deform the mirror surface.

(5) The fifth object of the present invention is to provide a recording device as mentioned in any one of the objects 2 to 4, which is characterized in that the image transfer intermediate is formed of transparent material and the ultraviolet irradiation unit is disposed within the image transfer intermediate to apply ultraviolet from opposite side to ink applied surface of the image transfer intermediate to the coat of the ink.

(6) The sixth object of the present invention is to provide a recording device as mentioned in the first object, which is characterized in that the ink is thermal curing ink and the ink curing means has heating means for heating the surface of the image transfer intermediate.

(7) The seventh object of the present invention is to provide a recording device as mentioned in the sixth object, which is characterized in that the heating means is composed of a resistance heating type micro-heater, an insulation film formed on the micro-heater and a heater pad formed on the insulation film and having a convex surface suitable for contacting the image transfer intermediate.

The recording device according to the present invention applies a coat of ink onto an image transfer intermediate, selectively cures parts of the applied ink coat and then transfers not-cured ink droplets onto a recording medium passing in contact with the image transfer intermediate. Thus, the recording device eliminates the possibility of clogging ink jet head with ink as be in a conventional ink-jet type device and can save electric power consumption as compared with the conventional device using hot-melt ink.

In the recording device, a tonal picture can be printed by controlling ultraviolet or heat for selective curing of the ink coat on the image transfer intermediate.

High-accuracy and high-quality printing can be achieved by applying ultraviolet or heat to fine portions of the ink coat by using the deformable mirror or a micro-heater respectively.

PREFERRED EMBODIMENTS OF THE INVENTION

Preferred embodiments of a recording device having an image transfer intermediate according to the present invention will be described below in detail:

First Embodiment

Figure 1:
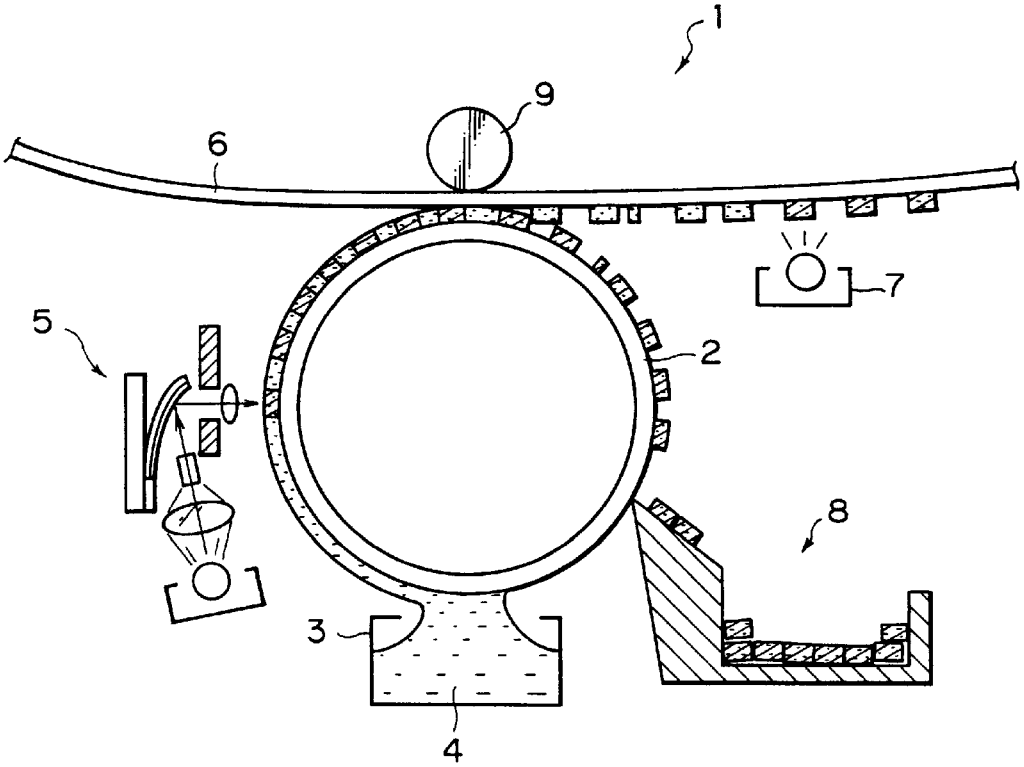
FIG. 1 is a view for explaining a structure and working principle of a recording device which is a first embodiment of the present invention.

FIG. 1 shows a hardware structure and working principle of a recording device which is a first embodiment of the present invention. In FIG. 1, the recording device 1 comprises an image transfer intermediate 2, an ink-feeding unit 3, ultraviolet curing ink 4, an ultraviolet ink-curing head 5, a recording medium 6, a thermal ink-curing unit 7 for fixing ink on the recording medium, an ink-removing unit 8 and platen 9.

Figure 2:
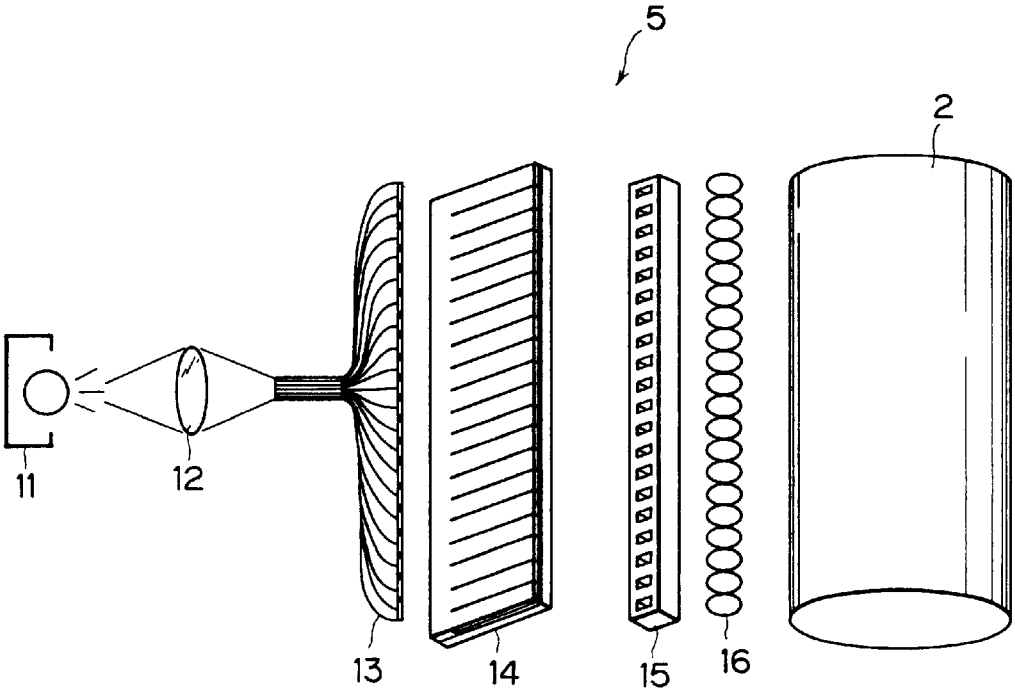
FIG. 2 is a construction view of an ultraviolet ink-curing head of the recording device according to the first embodiment.

FIG. 2 is an exploded construction view of the ultraviolet ink-curing head 5 used in the recording device of FIG. 1. As shown in FIG. 2, the ultraviolet ink-curing head 5 is composed of an ultraviolet irradiation unit 11, a convex lens 12, optical fibers 13, a deformable mirror array 14, a slit array 15 and a convex lens array 16.

Figure 3:
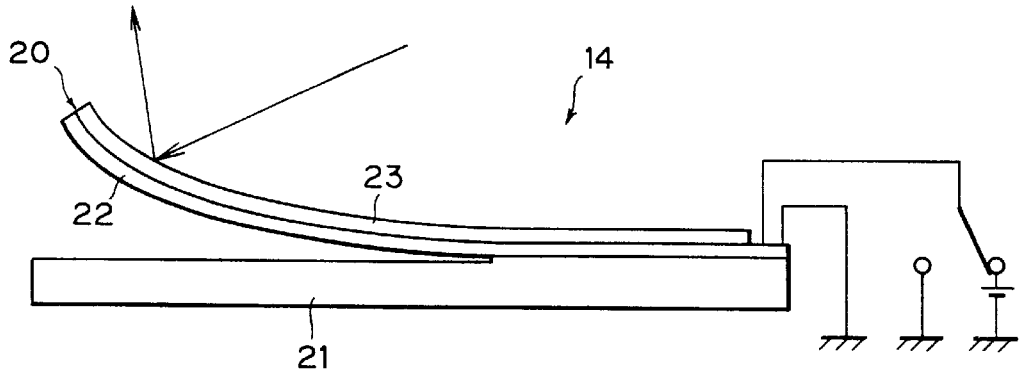
FIG. 3 is a view for explaining a structure and working principle of an example of deformable mirror used for the first embodiment of the present invention.
Figure 4:
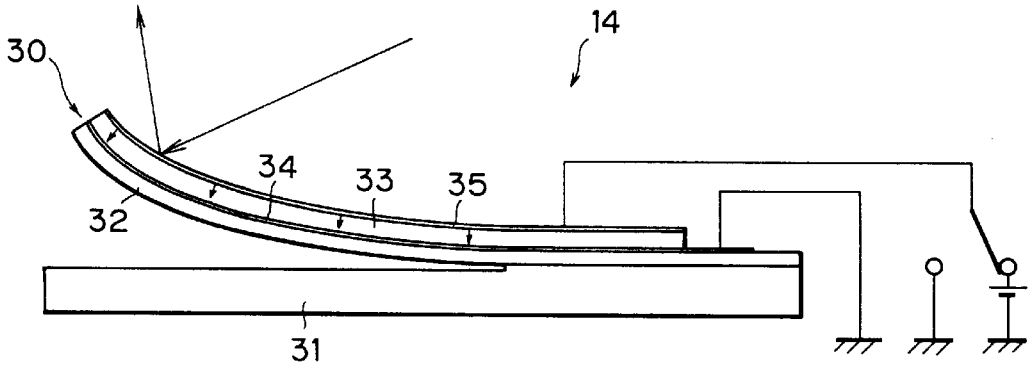
FIG. 4 is a view for explaining a structure and working principle of another example of the same deformable mirror as shown in FIG. 3.
Figure 5:
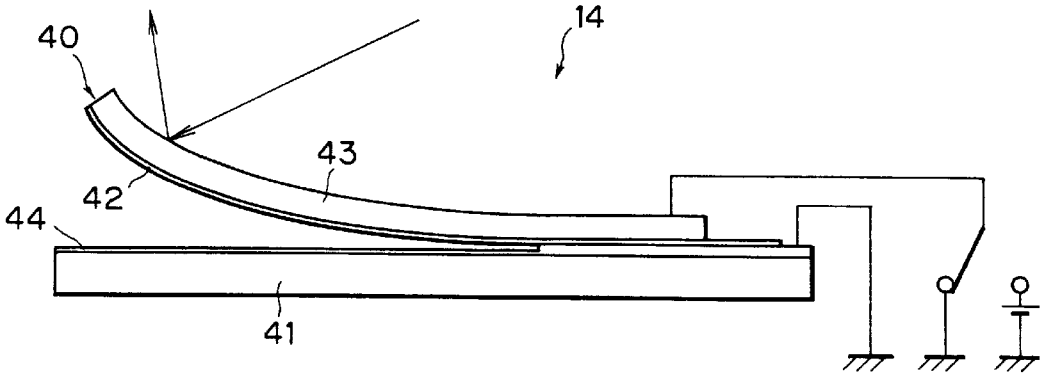
FIG. 5 is a view for explaining a structure and working principle of a further example of the same deformable mirror as shown in FIG. 3.

FIGS. 3, 4 and 5 illustrate three varieties of the deformable mirror array 14 of the recording device according to the first embodiment of the present invention. The deformable mirror array 14 may be a bimetal-made cantilever 20 (FIG. 3), a cantilever 30 made of lamination of an elastic member and a piezoelectric member (FIG. 4) and a cantilever made of a lamination of an elastic member and insulation member (FIG. 5).

In FIG. 1, the recording device 1 has an image transfer intermediate 2 whose external surface can be coated with ultraviolet curing ink 4 to be supplied from the ink-feeding unit 3. The ultraviolet ink-curing head 5 is disposed at a specified interval from the image transfer intermediate 2 with which the recording medium 6 is in contact under the pressure of the platen 9 for being fed. The thermal ink-curing unit 7 for fixing ink on the recording medium 6 is disposed at a specified gap from the latter. The ink-removing unit 8 is disposed with its knife edge being in contact with the external surface of the image transfer intermediate.

The operation of the thus constructed recording device is as follows:

Ultraviolet curing ink 4 is a normally liquid mixture of acrylic monomer, photopolymerization initiator and pigment, with which the ink-feeding unit 3 is filled. The ink is applied by a squeegee or an absorbing member of the ink-feeding unit 3 to the rotating image transfer intermediate 2 to form thereon an ink coat (layer) of a specified constant thickness.

The ultraviolet curing ink 4 coat on the image transfer intermediate 2 is selectively cured according to an image pattern to be printed on the recording medium 6 by applying ultraviolet from the ultraviolet ink-curing head 5. The ultraviolet curing method will be described later in detail.

The rotating image transfer intermediate 2 with the partially cured ultraviolet curing ink 4 coat impresses the recording medium 6 being forwarded under the pressure of the platen 9, transferring not-cured ultraviolet curing ink 4 on the recording medium 6 to form an ink pattern corresponding to the above-mentioned image pattern. In this case, ultraviolet curing ink 4 coat is transferred onto the recording medium 6 in amount corresponding to its curing degree. Namely, the completely cured parts of the ultraviolet curing ink 4 coat can not be transferred onto the recording medium 6 and half-cured ink can be transferred thereto in an amount depending upon its curing degree. This makes it possible to achieve high-quality high-speed halftone printing.

The ink representing the image pattern on the recording medium 6 is cured by ultraviolet emitted from thermal ink-curing unit 7 for fixing ink consisting of a mercury lamp or the like. The image pattern developed with the ultraviolet curing ink 4 is thus finally fixed on the recording medium 6.

Residual cured ultraviolet curing ink 4 coating on the image transfer intermediate 2 are scraped off by the ink-removing unit 8.

As described above, the recording device of the first embodiment first applies a coat of ultraviolet curing ink to the image transfer intermediate, forms a recordable image pattern in the ink coat on the image transfer intermediate by selectively curing only not-recordable parts of the ink coat by ultraviolet curing from the ultraviolet ink-curing head and then transfers not-cured parts of the ink coat onto the recording medium. Thus, this recording device is entirely free from troubles that may occur in a conventional ink-jet type recording device. Namely, there is no clogging with ink and no need of replacing a head with new one. The electric power consumption is saved because of using ultraviolet curing ink instead of hot-melt ink.

Referring to FIG. 2, a method of curing ultraviolet curing ink 4 by using the ultraviolet ink-curing head 5 is described below.

The operation of the ultraviolet ink-curing head 5 is as follows:

Ultraviolet emitted from a mercury-arc lamp or of the ultraviolet irradiation unit 11 passes through the convex lens 12 and dispersed through the optic fibers 13 in the longitudinal direction on the image transfer intermediate 2. The dispersed ultraviolet are reflected by the deformable mirror array 14 whose mirrors change strength of reflected therefrom rays by changing reflection angles. The reflected ultraviolet rays pass the slit array 15 and then the convex lens array 16 through which the ultraviolet rays appear as converging light. The reflected light has a large strength when reflected by the deformable mirror deformed at a certain maximal angle and it can cure the ultraviolet curing ink 4 coat applied on the image transfer intermediate. No ultraviolet is applied to the ultraviolet curing ink 4 coat on the image transfer intermediate when the deformable mirror is not deformed. The ultraviolet curing ink 4 can be half cured when the deformable mirror is deformed at a half angle to reflect a half amount of the ultraviolet. Thus, the strength of the reflected light can be continuously changed by adjusting the deformation angle of the deformable mirror. This enables continuous adjustment of the degree of curing of the ink. The quantity of light can be controlled by using a combination of the cantilever type deformable mirror and the slit, thus enabling writing a fine pattern on the ink coat applied on the image transfer intermediate.

Referring to FIG. 3, the deformable lens array 14 described as follows:

This deformable mirror array 14 is composed of a bimetal cantilever 20 that is manufactured by laminating two kinds of metals having different linear expansion coefficients on a substrate 21. For example, a first material 22 of nickel having a large linear expansion coefficient ($\alpha=13.4\times10^{-6}$) is formed on the substrate and then a second material 23 of quartz glass having a small linear expansion coefficient ($\alpha=4.6\times10^{-6}$) is formed thereon. It is preferable to use a combination of materials having different linear expansion coefficients which ratio is not less than 2.

The cantilever 20 is previously set in its stress so that it may be parallel to the substrate 21 with no current applied to the first material 22. The stress adjustment of the cantilever 20 is achieved by adjusting conditions of forming the films of materials on the substrate 21. For example, in the case of using nickel as the first material 22 and quartz glass as the second material 23, a film of nickel is formed on the substrate 21 by electroplating with current density preset to 20 mA/cm$^2$ at which the nickel can not be subjected to stress. A film of quartz glass is then formed thereon by sputtering the material in an argon gas of 8 mTorr by applying an electric power set at 1 kW, not allowing quartz glass to have stress.

When current is supplied to the first material 22 of the cantilever 20, bimetal is heated by joule heat and its free end is curved apart from the substrate 21.

As be apparent from FIG. 2, the optical system of the embodiment is previously adjusted so that the intensity of reflected light passing through the slit array 15 is zero with no current applied to the bimetal of the cantilever type mirror 20 and may increase as the current is increased. Thus, the intensity of reflected light to be applied to the image transfer intermediate 2 can be continuously adjusted by adjusting the current value applied to the cantilever 20 of the deformable mirror array 14.

FIG. 4 shows the structure of another deformable mirror array 14. Each deformable mirror of the deformable mirror array 14 is a cantilever 30 composed of a substrate 31 having a formed thereon lamination of an elastic member (made of, e.g., nickel) 32 and a piezoelectric member (made of, e.g., lead zirconate titanate PZT) 33 having an under electrode 34 and upper electrode 35 on respective sides.

The piezoelectric member 33 is polarized in the direction toward the thickness of substrate 31. With an electric field applied across both upper and lower electrodes, the piezoelectric member 33 shrinks and causes a free end of the cantilever 30 to bend apart from the substrate 31. With no electric field, the cantilever 30 set in its stress so that it recovers its initial state parallel to the substrate 31.

Similarly to the deformable mirror array 14 shown in FIG. 3, the deformable mirror array 14 works in an optical system which is aligned so that the intensity of reflected light passing through a slit array is equal to zero without electric field and increases as the electric field increases. Thus, the intensity of reflected light to be applied through each slit to the image transfer intermediate 2 can be continuously adjusted by adjusting the current value applied to each of mirrors in the deformable mirror array 14.

FIG. 5 is a construction view of another deformable mirror array 14. Each deformable mirror is a cantilever 40 composed of a substrate 41 having an elastic member 43 (made of, e.g., nickel) formed thereon and an insulating member 42 (made of, e.g., silicon dioxide) formed on the elastic member 43.

An electrode is formed on the cantilever 40 (elastic member 43 made of nickel can serve as an electrode as shown in the case of FIG. 5) and an electrode 44 is formed on the substrate 41. When an electric field is applied across both electrodes, the free of the cantilever 40 is bent toward the substrate 41 by the effect of an electrostatic force. With no electric field, the cantilever 40 curves its free end apart from the substrate 41. Stress acting on the cantilever 40 can be preset by adjusting conditions of forming the films of materials on the substrate 41. For example, in the case of using nickel as the elastic member 43, a film of nickel is formed on the substrate 41 by electroplating with current density of 30 mA/cm$^2$ at which the nickel is subjected to a certain suitable stress of elongation.

Similarly to the deformable mirror arrays 14 shown in FIGS. 3 and 4, this deformable mirror array 14 works in an optical system which is aligned so that the intensity of reflected light passing through a slit array is equal to zero without electric field and increases as the electric field increases. Thus, the intensity of reflected light to be applied through each slit to the image transfer intermediate 2 can be continuously adjusted by controlling the electric field applied to each of mirrors in the deformable mirror array 14.

As described above, the recording devices embodying the present invention can write an image pattern into an ink coat on the image transfer intermediate by using light reflected by a deformable mirror array, thus achieving high-integration of an ultraviolet curing head capable of high-quality and high-speed printing of half-tone images.

Figure 6:
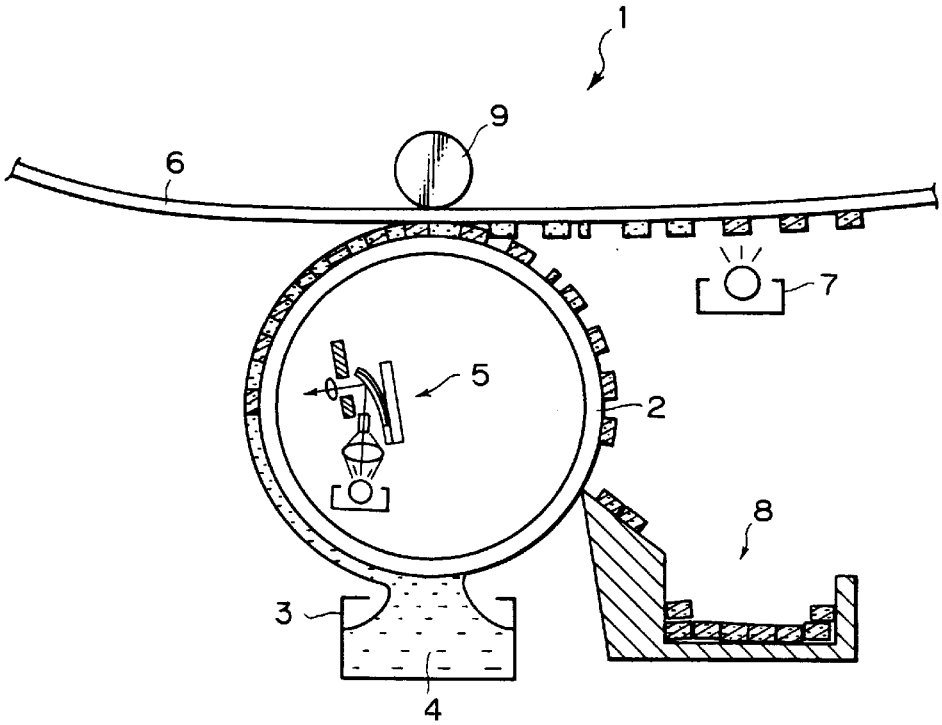
FIG. 6 is a view for explaining another structure and working principle of the same recording device as shown in FIG. 1.

Although the above-described embodiments use an ultraviolet curing head disposed opposite to a surface of an image transfer intermediate to be coated with an ink (FIG. 1), it is also possible to dispose an ultraviolet ink-curing head 5 inside an image transfer intermediate 2 made of a transparent material such as glass or plastics having a high transmittance as shown in FIG. 6. Thus designed device is much compact as compared with the device shown in FIG. 1.

Second Embodiment

Figure 7:
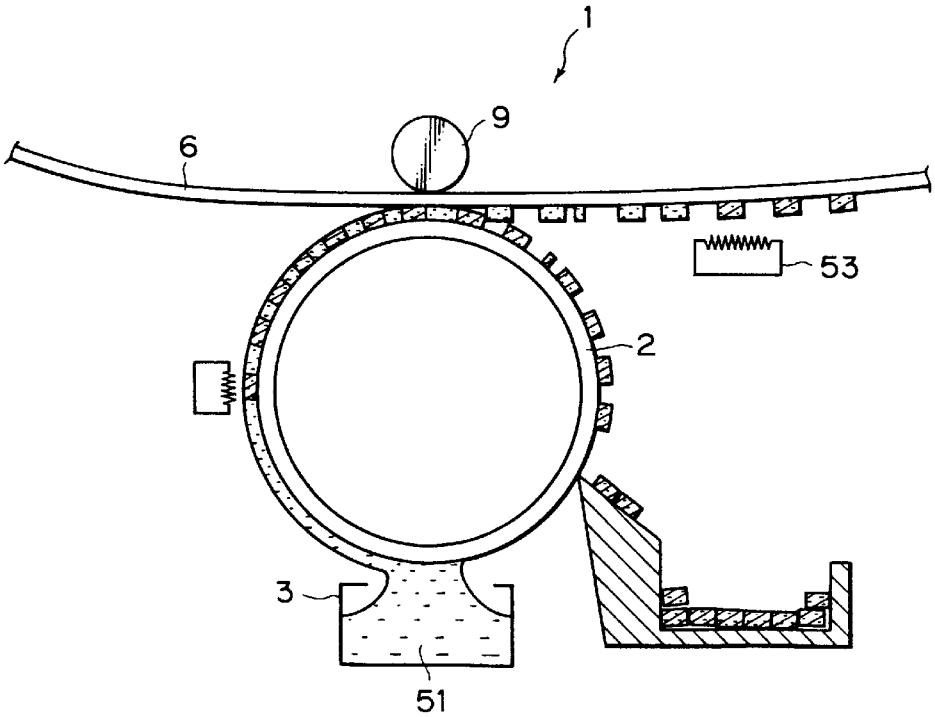
FIG. 7 is a view for explaining a structure and working principle of a recording device which is a second embodiment of the present invention.

FIG. 7 is a view for explaining the structure and operation principle of a recording device which is a second embodiment of the present invention. This embodiment differs from the first embodiment in that it uses normally liquid thermal curing ink 51 prepared from epoxy resin monomer, polymerization initiator and pigment; a thermal ink-curing head 52 composed of micro-heater array; and a thermal ink-curing unit 53 for fixing ink on the recording medium being composed of a resistance heater.

The operation of this recording device is as follows:

The thermal curing ink 51 stored in the ink-feeding unit 3. The ink is applied by a squeegee or an absorbing member of the ink-feeding unit 3 to the rotating image transfer intermediate 2 to form thereon an ink coat of a specified constant thickness.

The thermal curing ink 51 applied on the image transfer intermediate 2 is selectively cured according to an image pattern to be printed on the recording medium 6 by heat from the thermal ink-curing head 52. The ink curing method will be described later in detail.

The rotating image transfer intermediate 2 with the partially cured thermal curing ink 51 coat impresses the recording medium 6 being forwarded under the pressure of the platen 9, transferring the not-cured thermal curing ink onto the recording medium to form an ink image pattern corresponding to the above-mentioned image pattern. In this case, thermal curing ink 51 coat is transferred onto the recording medium 6 in amount corresponding to its curing degree. Namely, the completely cured parts of the ink layer can not be transferred onto the recording medium 6 and half-cured ink can be transferred thereto in an amount depending upon its curing degree. This makes it possible to achieve high-quality high-speed halftone printing.

The ink representing the image pattern on the recording medium 6 is cured by heat emitted from the thermal ink-curing unit 53 for fixing ink consisting of resistance heating unit. The image pattern developed with the ink is thus finally fixed on the recording medium 6.

The thermal curing ink 51 coat on the image transfer intermediate 2 are scraped off by the ink-removing unit 8.

The recording device repeats the above-mentioned cycle of operation. The method of curing thermal curing ink 51 by using the thermal ink-curing head 52 is now described below.

Figure 8:
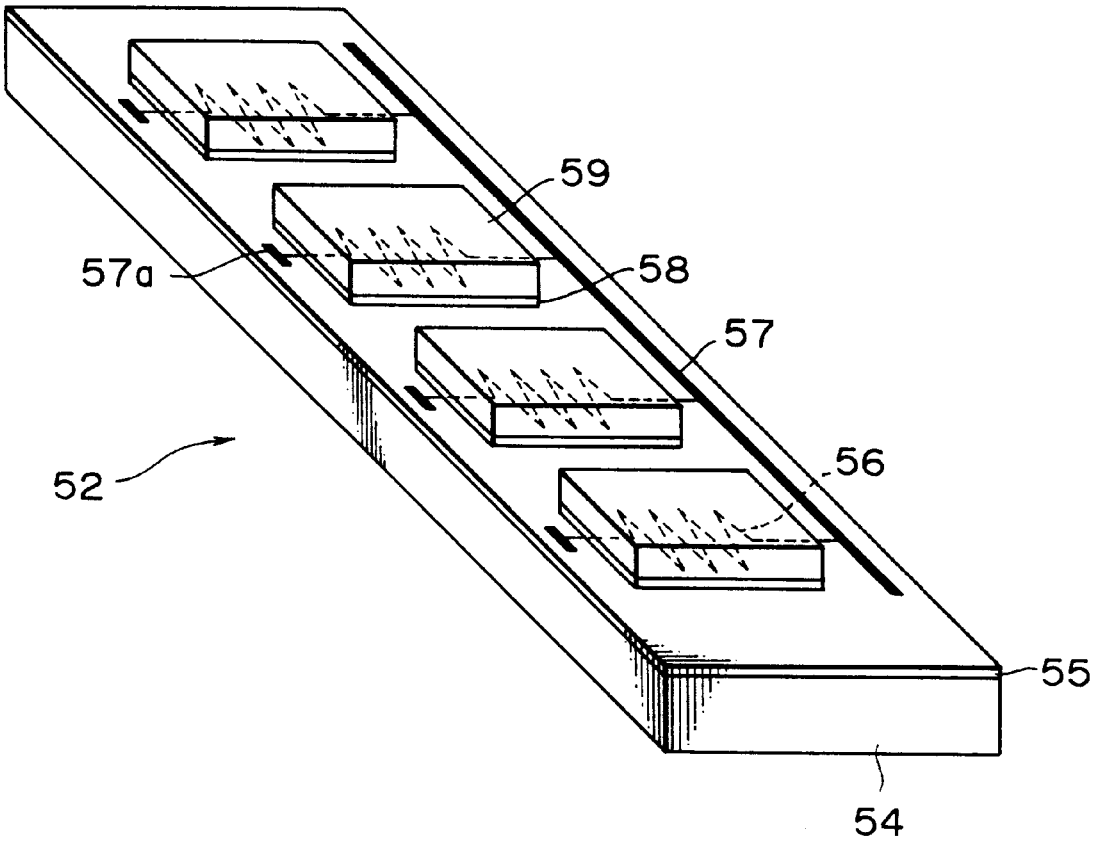
FIG. 8 is a construction view of a thermal ink-curing head of the recording device according to the second embodiment of the present invention.

As shown in detail in FIG. 8, the thermal ink-curing head 52 comprises a substrate 54 made of silicon or metal having a high thermal conductivity, whereon a micro-heater array 56, an electrode 57 and a selecting electrode 57*a* are formed with underlying insulation films 55 and a heater pad 59 made of metal having a high heat-conductivity (e.g., nickel) is formed with an underlying insulation film 58. The head has a high thermal response characteristic suitable for high-speed printing because of its substrate 54 made of metal having a high heat-conductivity. The thermal ink-curing head 52 can effectively use heat and, therefore, save electric power consumption by using the heater pad 59 made of material having high thermal conductivity. Furthermore, the thermal ink-curing head 52 is adapted for high-quality printing because channels (micro-heaters) are thermally isolated from each other by the insulation films 55, 58 and the heating pad 59 to minimize a thermal influence between the channels.

As described above, the recording device of the second embodiment for writing an image pattern on the image transfer intermediate by using the micro heaters has, therefore, high integration of its thermal ink-curing head and is suitable for high quality and high-speed halftone printing.

Third Embodiment

This embodiment relates to a method of manufacturing a deformable mirror array shown in the first embodiment of the present invention. FIGS. 9A to 9G show the process of manufacturing a bimetal type cantilever, FIGS. 10A to 10I show the process of manufacturing a cantilever composed of a piezoelectric member and an elastic member and FIGS. 11A to 11H show the process of manufacturing a cantilever composed of an elastic member and an insulating member.

Figure 9A:
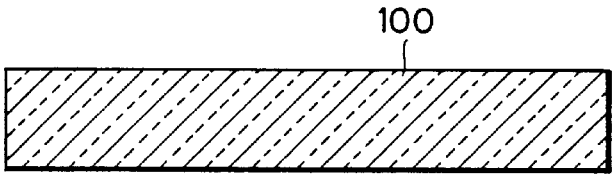
FIGS. 9A, 9B, 9C, 9D, 9E, 9F and 9G depict steps of manufacturing the deformable mirror shown in FIG. 3.

Referring to FIGS. 9A to 9G, the method of manufacturing the bimetal type cantilever is described as follows:

(I) A glass substrate 100 is used as shown in FIG. 9A.

Figure 9B:
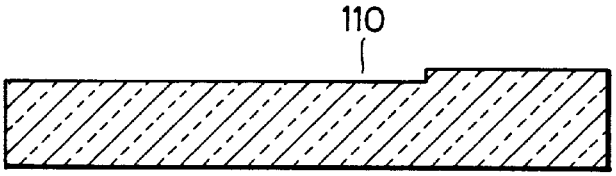

(II) As shown in FIG. 9B, a mask of, e.g., nickel is formed at a specified thickness (e.g., 1 $\mu$m) on each of the top and bottom surfaces of the glass substrate 100. The patterning corresponding to the configuration of a concave 110 is made by etching the glass substrate with hydrofluoric acid by depth of 2 $\mu$m and by removing the nickel mask with nitric acid.

Figure 9C:
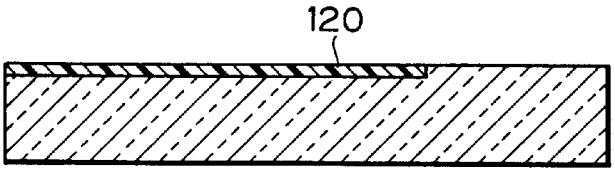

(III) As shown in FIG. 9C, the concave is coated with a sacrificial layer of polyimide 120.

Figure 9D:
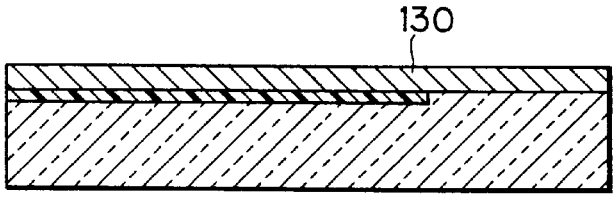

(IV) As shown in FIG. 9D, a 0.01 $\mu$m thick film of tantalum (not shown) and a 0.1 $\mu$m thick film of nickel (not shown) are formed by sputtering method on the substrate and, then, a nickel layer of a specified thickness (e.g., 5 $\mu$m) is formed thereon by electroplating using the previously formed tantalum and nickel thin-films as electrodes. The electroplating may be conducted using a plating bath of, e.g., nickel sulfamic acid. The current density is set at 20 A/cm$^2$ for plating. The tantalum film is serves to improve adhesion of nickel to the glass substrate 100. A coat of photo-resist (not shown) is applied onto the nickel film, then patterning is made thereon according to the configuration of an elastic member 130 and the photo-resist is removed off.

Figure 9E:
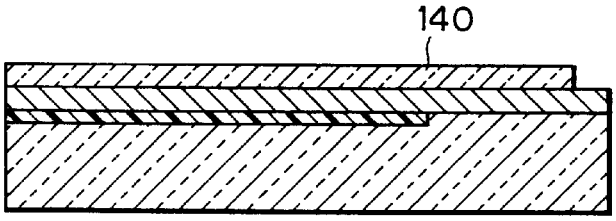

(V) As shown in FIG. 9E, a 5 $\mu$m thick film of quartz glass 140 is formed by, e.g., sputtering on the nickel film formed on the substrate. The formed guartz-glass film is patterned to a specified shape by ion-beam milling or reactive ion etching (RIE). The quartz glass sputtering is conducted in an argon gas atmosphere of 8 mTorr by applying an electric power set at 1 kW.

Figure 9F:
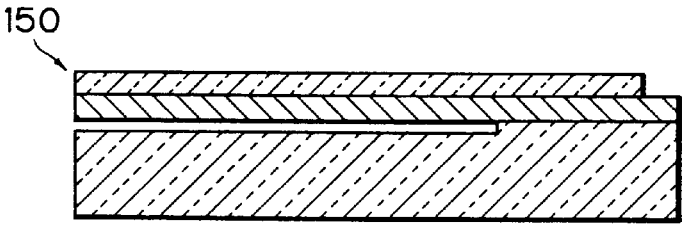

(VI) As shown in FIG. 9F, the glass substrate 100 with the formed thereon films of different materials is dipped into a potasium hydroxide solution. The sacrificial polyimide layer is etched off to separate a deformable projecting portion of the cantilever 150 from the glass substrate 100.

Figure 9G:
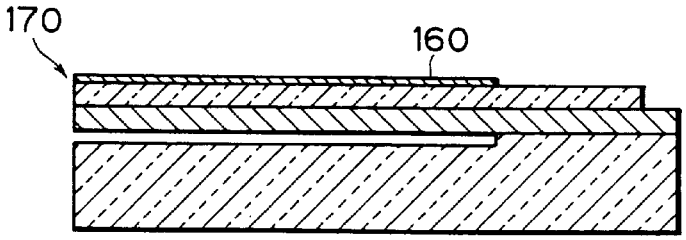

(VII) Finally, a 0.1 $\mu$m thick film of aluminum 160 is formed by, e.g., sputtering and patterned to have a specified reflecting surface. Thus, a deformable mirror 170 is finished as shown in FIG. 9G.

Figure 10A:
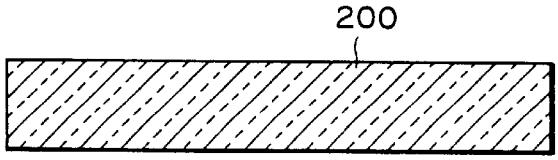
FIGS. 10A, 10B, 10C, 10D, 10E, 10F, 10G, 10H and 10I depict steps of manufacturing the deformable mirror shown in FIG. 4.

Referring to FIGS. 10A to 10I, the method of manufacturing a cantilever composed of a piezoelectric member and an elastic member is described as follows:

(I) A glass substrate 200 is used as shown in FIG. 10A.

Figure 10B:
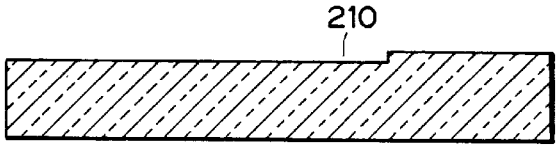

(II) As shown in FIG. 10B, a mask of, e.g., nickel is formed at a specified thickness (e.g., 1 $\mu$m) on each of the top and bottom surfaces of the glass substrate 200. The patterning corresponding to the configuration of a concave 210 is made by etching the glass substrate with hydrofluoric acid by depth of 2 $\mu$m and by removing the nickel mask with nitric acid.

Figure 10C:
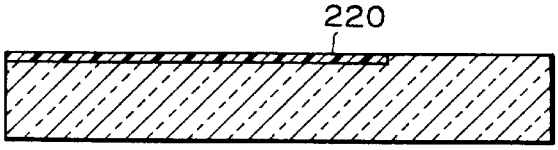

(III) As shown in FIG. 10C, the concave is coated with a sacrificial layer of polyimide 220.

Figure 10D:
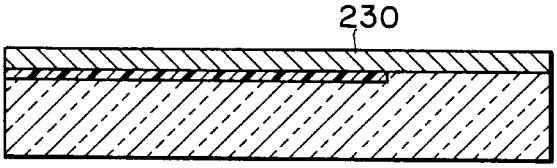

(IV) As shown in FIG. 10D, a 0.01 $\mu$m thick film of tantalum (not shown) and a 0.1 $\mu$m thick film of nickel (not shown) are formed by sputtering method on the substrate and, then, a nickel layer of a specified thickness (e.g., 5 $\mu$m) is formed thereon by electroplating using the previously formed tantalum and nickel thin-films as electrodes. A coat of photo-resist (not shown) is applied onto the nickel film. Patterning is made thereon according to the configuration of an elastic member 230 and the photo-resist is then removed off.

Figure 10E:
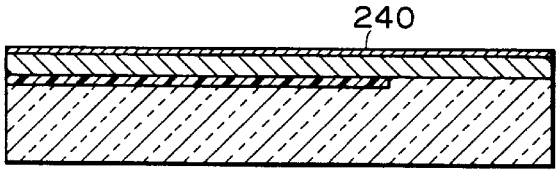

(V) As shown in FIG. 10E, a 0.1 $\mu$m thick film of platinum 240 is formed by, e.g., sputtering on the nickel film formed on the substrate. The formed platinum film is patterned to a specified lower-electrode shape by ion-beam milling or reactive ion etching.

Figure 10F:
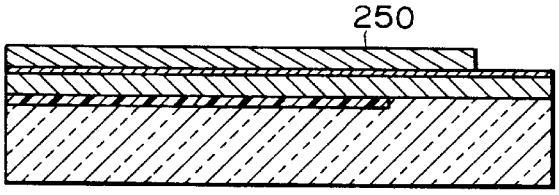

(VI) As shown in FIG. 10F, a 5 $\mu$m thick film of PZT 250 is formed on the lower-electrode platinum film and patterned to a specified shape by ion-beam milling.

Figure 10G:
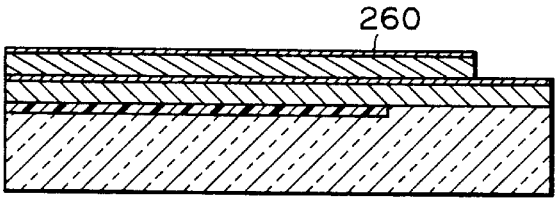

(VII) As shown in FIG. 10G, a 0.1 $\mu$m thick film of platinum 260 is formed thereon by, e.g., sputtering and patterned to a specified upper-electrode shape by ion-beam milling or reactive ion etching.

Figure 10H:
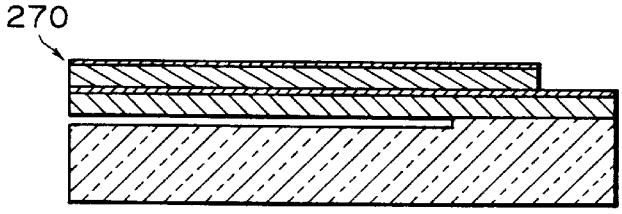

(VIII) As shown in FIG. 10H, the glass substrate 200 with the formed thereon films of different materials is dipped into a potasium hydroxide solution. The sacrificial polyimide layer is etched off to separate a deformable projecting portion of the cantilever 270 from the glass substrate 200.

Figure 10I:
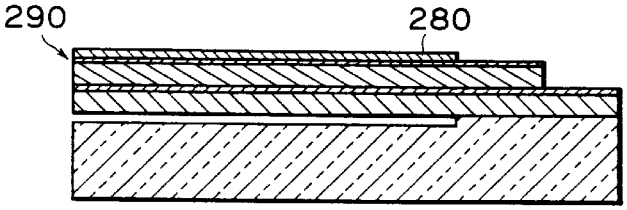

(IX) Finally, a 0.1 μm thick film of aluminum 280 is formed by, e.g., sputtering and patterned to have a specified reflecting surface. Thus, a deformable mirror 290 is finished as shown in FIG. 10I.

Referring to FIGS. 11A to 11H, the method of manufacturing a cantilever composed of an elastic member and an insulation member.

Figure 11A:
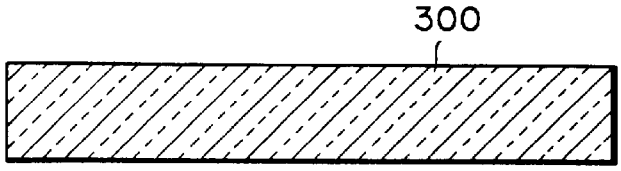
FIGS. 11A, 11B, 11C, 11D, 11E, 11F, 11G and 11H depict steps of manufacturing the deformable mirror shown in FIG. 5.

(I) A glass substrate 300 is used as shown in FIG. 11A.

Figure 11B:
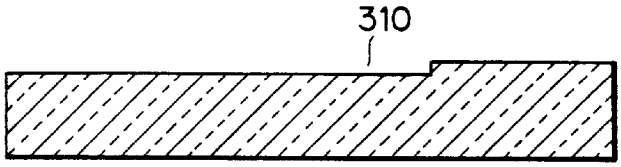

(II) As shown in FIG. 11B, a mask of, e.g., nickel is formed at a specified thickness (e.g., 1 μm) on each of the top and bottom surfaces of the glass substrate 300. The patterning corresponding to the configuration of a concave 310 is made by etching the glass substrate with hydrofluoric acid by depth of 2 μm and by removing the nickel mask with nitric acid.

Figure 11C:
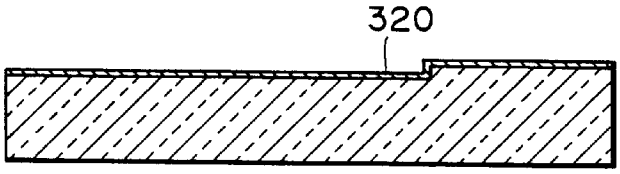

(III) As shown in FIG. 11C, a 0.1 μm thick film of platinum 320 is formed by, e.g., sputtering on the nickel film formed on the substrate. The formed platinum film is patterned to a specified lower-electrode shape by ion-beam milling or reactive ion etching.

Figure 11D:
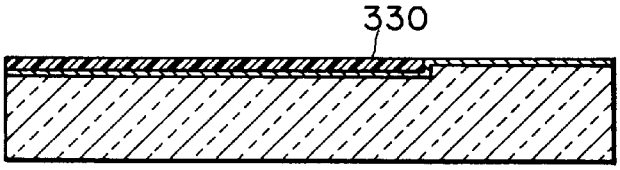

(IV) As shown in FIG. 11D, the concave is coated with a sacrificial layer of polyimide 330.

Figure 11E:
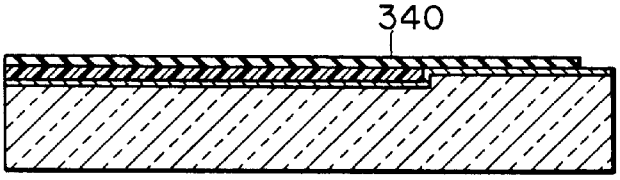

(V) As shown in FIG. 11E, a 0.1 μm thick insulation film of silicon dioxide 340 is formed thereon by, e.g., sputtering and patterned to a specified shape by ion-beam milling or reactive ion etching.

Figure 11F:
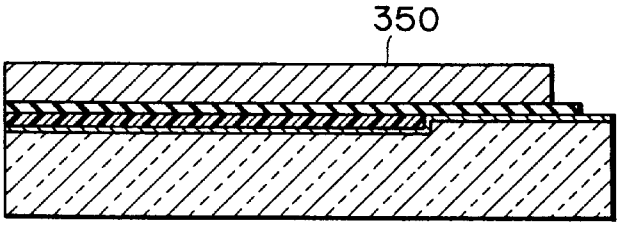
Figure 11G:
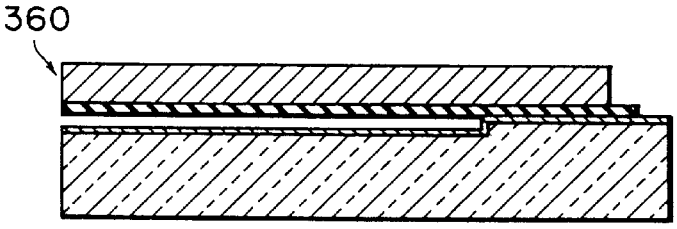
Figure 11H:
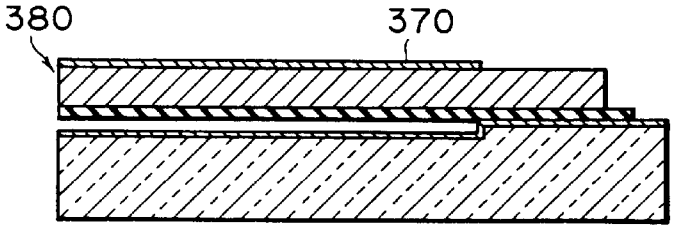

(VI) As shown in FIG. 11F, a 0.01 μm thick film of tantalum (not shown) and a 0.1 μm thick film of nickel (not shown) are formed by sputtering method on the substrate and, then, a nickel layer of a specified thickness (e.g., 5 μm) is formed thereon by electroplating using the previously formed tantalum and nickel thin-films as electrodes. A coat of photo-resist (not shown) is applied onto the nickel film. Patterning is made thereon according to the configuration of an elastic member 350 and the photo-resist is then removed off.

(VII) As shown in FIG. 10G, the glass substrate 300 with the formed thereon films of different materials is dipped into a potasium hydroxide solution. The sacrificial polyimide layer is etched off to separate a deformable projecting portion of the cantilever 360 from the glass substrate 300.

(VIII) Finally, a 0.1 μm thick film of aluminum 370 is formed by, e.g., sputtering and patterned to have a specified reflecting surface. Thus, a deformable mirror 380 is completed as shown in FIG. 10H.

The above-described manufacturing methods are based on the lithographic technology and can therefore produce a deformable mirror array which enables an ultraviolet ink-curing head of the recording device to be suitable for high-speed printing. Consequently, it becomes possible to manufacture a compact recording device at an inexpensive cost.

Fourth Embodiment

This embodiment relates to a method of manufacturing a thermal ink-curing head shown in the second embodiment of the present invention, which is explained below referring to FIGS. 12A to 12D.

Figure 12A:
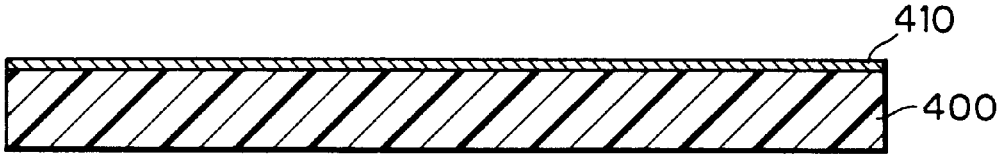
FIGS. 12A, 12B, 12C and 12D depict steps of manufacturing the thermal ink-curing head shown in FIG. 8.

(I) As shown in FIG. 12A, a glass substrate 400 is used as a base plate whereon a thermo-oxide film 410 is first formed.

Figure 12B:
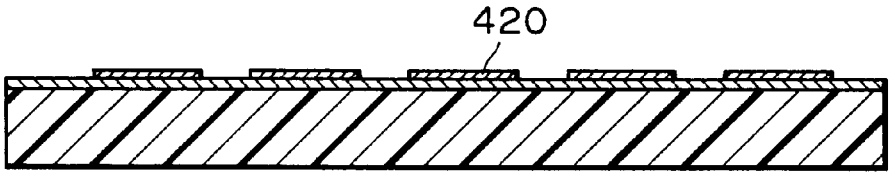

(II) As shown in FIG. 12B, a 0.1 μm thick film of, e.g., nickel is formed by using, e.g., a sputtering method on the thermo-oxide film 410 and patterned to a specified shape of heater 420.

Figure 12C:
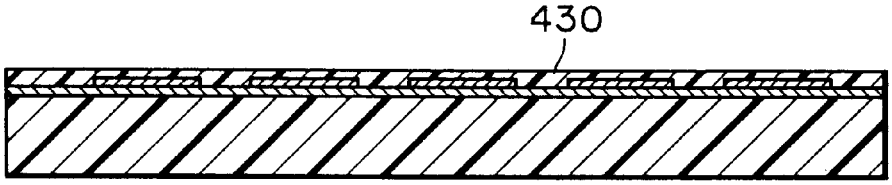

(III) As shown in FIG. 12C, a 0.1 μm thick film of silicon dioxide 430 is formed thereon as an insulation film by applying, e.g., a sputtering method.

Figure 12D:
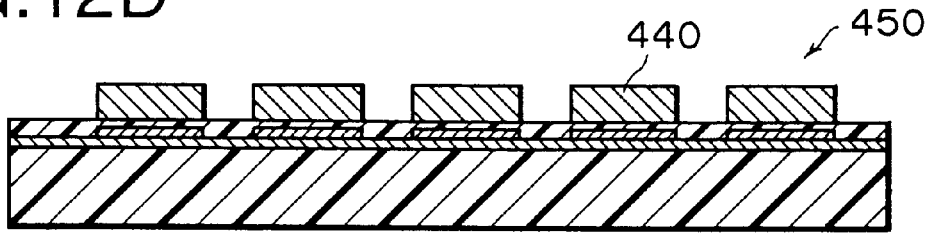

(IV) As shown in FIG. 12D, a 0.01 μm thick film of tantalum (not shown) and a 0.1 μm thick film of nickel (not shown) are formed by a sputtering method on the film of silicon dioxide and, then, a nickel layer of a specified thickness (e.g., 10 μm) is formed thereon by electro-plating using the previously formed tantalum and nickel thin-films as electrodes. A coat of photo-resist (not shown) is applied onto the nickel film, then patterning is made thereon according to the configuration of a heater pad 440 and the photo-resist is removed off. Thus, a micro-heater array 450 is completed.

The above-described manufacturing method are based on the lithographic technology and can therefore produce a micro-heater array which enables a thermal ink-curing head of the recording device to be a highly integrated part suitable for high-speed printing. Consequently, it becomes possible to provide a compact inexpensive recording device.

As is apparent from the foregoing, a recording device according to the present invention is capable of applying an ink coat onto an image transfer intermediate and selectively curing, by ultraviolet or heat, parts not relating to an image pattern to be printed. The image transfer intermediate then transfers not-cured ink (representing the image pattern) onto a recording medium when contacting with the image transfer intermediate. Accordingly, the recording device eliminates the need for replacing the writing head due to contamination with ink, thus reducing its running cost. Furthermore, the recording device can save electric power consumption since it uses ink that is normally liquid, not requiring melting by heat.

The recording device according to the present invention is capable of selectively curing ink by ultraviolet or heat by using a deformable mirror or micro-heater, thus improving an integration of its writing (ink-curing) head and enabling high-quality and high-speed printing recording of a desired image.

We claim:

1. A recording device for recording an image pattern on a recording medium by ink onto an image transfer intermediate and further transferring the inked image pattern onto the recording medium, which is provided with ink applying means for applying a coat of liquid ink on the image transfer intermediate, ink curing means for selectively curing the liquid ink coat on the image transfer intermediate according to the image pattern and transfer means for transferring the recording medium into contact with the image transfer intermediate to transfer still not-cured ink from the image transfer intermediate onto the recording medium.

2. A recording device as defined in claim 1, wherein the ink is ultraviolet curing ink and the ink curing means is provided with ultraviolet irradiation unit.

3. A recording device as defined in claim 2, wherein the ink curing means is provided with a deformable mirror deformably formed for reflecting ultraviolet from the ultraviolet irradiation unit at an angle suitable for the image pattern to be recorded and a slit for passing reflected light from the deformable mirror.

4. A recording device as defined in claim 3, wherein the deformable mirror comprises a cantilever having a mirror surface and driving portion for driving the cantilever by applying any one of heat, electric field and electrostatic field to deform the mirror surface.

5. A recording device as defined in claim 2, wherein the image transfer intermediate is formed of transparent member and the ultraviolet irradiation unit is disposed within the image transfer intermediate to apply ultraviolet from opposite side to the ink applied surface of the image transfer intermediate to a coat of the ink.

6. A recording device as defined in claim 1, wherein the ink is thermal curing ink and the ink curing means has heating means for heating the surface of the image transfer intermediate.

7. A recording device as defined in claim 6, wherein the heating means is composed of a resistance heating type micro-heater, an insulation film formed on the micro-heater and a heater pad formed on the insulation film and having a convex surface for contacting the image transfer intermediate.

* * * * *